United States Patent [19]

Takashima et al.

[11] Patent Number: 4,686,081

[45] Date of Patent: Aug. 11, 1987

[54] METHOD FOR ADDITION OF LOW-MELTING POINT METAL

[75] Inventors: Kiyoshi Takashima; Isao Suzuki; Masashi Yoshida; Ryutatsu Tanaka; Noriyuki Masumitsu; Kazuhiro Kinoshita; Hiromi Ishii, all of Muroran, Japan

[73] Assignee: Nippon Steel Corporation, Tokyo, Japan

[21] Appl. No.: 865,472

[22] Filed: May 21, 1986

Related U.S. Application Data

[63] Continuation-in-part of Ser. No. 829,813, Feb. 14, 1986, abandoned.

[30] Foreign Application Priority Data

| | | | |
|---|---|---|---|
| Feb. 18, 1985 | [JP] | Japan | 60-29895 |
| Feb. 18, 1985 | [JP] | Japan | 60-29896 |
| Apr. 19, 1985 | [JP] | Japan | 60-82538 |
| May 8, 1985 | [JP] | Japan | 60-95898 |

[51] Int. Cl.[4] ..... C22C 33/00

[52] U.S. Cl. ..... 420/29; 420/41

[58] Field of Search ..... 75/53, 58; 420/29, 41

[56] References Cited

U.S. PATENT DOCUMENTS

| | | | |
|---|---|---|---|
| 3,998,625 | 12/1976 | Koros | 75/53 |
| 4,435,210 | 3/1984 | Hirokawa | 75/53 |
| 4,462,823 | 7/1984 | Fontaine | 75/53 |

OTHER PUBLICATIONS

Journal of The Iron and Steel Institute of Japan, vol. 68, No. 4, Mar. 1982.

*Primary Examiner*—Peter D. Rosenberg
*Attorney, Agent, or Firm*—Wenderoth, Lind & Ponack

[57] ABSTRACT

A method of adding a low-melting point metal (e.g. Pb or Bi) to liquid steel for producing a free-cutting steel in a consistent manner and in high yield of addition is disclosed. In accordance with the method, at least one member selected from said low-melting point metal and an oxide thereof, and at least one member selected from the group consisting of quick lime and a carbonaceous material are mixed in specified optimum proportions and the mixture is blown into the liquid steel through an injection lance. The liquid steel may be agitated while the mixture is added, and the appropriate conditions for the agitation of the steel are also specified.

4 Claims, 7 Drawing Figures

METHOD FOR ADDITION OF LOW-MELTING POINT METAL

This application is a continuation-in-part application of application Ser. No. 829,813, filed Feb. 14, 1986 (now abandoned).

BACKGROUND OF THE INVENTION

1. Field of the Invention

The present invention relates to a method of adding to molten steel a low-melting point metal such as lead or bismuth that provides free-cutting properties and/or a low-melting point metal-containing material such as lead oxide or bismuth oxide for the purpose of producing steels containing said low-melting point metals such as, for example, machine structural steels, Al-Si killed steels for use in automotive bodies, and free-cutting steels containing low carbon and sulfur.

For the purpose of description of the present invention in the following pages, the low-melting point metal and/or low-melting point metal-containing material will sometimes be collectively referred to as a source of low-melting point metal.

2. Prior Art

It is known that a source of low-melting point metal such as lead or bismuth that was added to steel exists either independently or as a sulfide to provide significant improvement of the free-cutting property of the steel.

The source of low-melting point metal may be added to steel by the following three methods: (a) the source is added while liquid steel is poured into an ingot making mold; (b) the source is added from above to the liquid steel in a ladle while the steel is agitated with an inert gas such as Ar or $N_2$ that is blown into the ladle from below, and the steel then is subjected to continuous casting; and (c) the source and the inert gas are injected through a submerged lance into the liquid steel in a ladle, and the steel then is subjected to continuous casting. With the increased use of the continuous casting method, the procedures (b) and (c) have recently come to be employed extensively. However, the method (b) wherein the source of low-melting point metal is dropped from above and ladle is disadvantageous in that the source which usually has a greater specific gravity than iron (Pb, 11.34 or Bi, 9.80>Fe, 7.8) will be dispersed unevenly within the liquid steel and that the low-melting point metal being added will be oxidized to reduce the yield or efficiency of addition of such low-melting point metal source. Because of these disadvantages, the steel into which the source of low-melting point metal is added by the method (b) does not have uniform free-cutting properties and cannot be produced without causing air pollution by lead oxides. The method (c) wherein the source of low-melting point metal is injected into the liquid steel through a submerged lance is free from the aforementioned problems and, hence, is regarded as a favorable means.

One prior art method for injecting a lead-containing substance into molten steel through a submerged lance is described in "Tetsu to Hagane (Iron and Steel)", vol. 68, No. 4, March 1982, '82-S253, The Iron and Steel Institute of Japan. In order to enable gas-carried injection of lead which, in its elemental form, has a specific gravity of as great as 11.34, the apparent specific gravity of lead is reduced and its uniform dispersion in liquid steel is ensured by mixing the lead-containing material with quick lime.

Another version of the method (c) is disclosed in Laid-Open Japanese Patent Publication No. 46311/1985 (laid open to public inspection on Mar. 13, 1985); in this method, a low-melting point metal such as Pb or Bi is mixed with a suflide, either independently or in combination with an oxide thereof, for the same purpose of reducing the apparent specific gravity of Pb or Bi.

The aforementioned prior art methods for adding sources of low-melting point metals involve the following problems.

(i) In the method (c) proposed in "Tetsu to Hagane", ibid., quick lime which usually serves as a desulfurizing flux cannot be added in a large amount because, otherwide, desulfurization occurs while the mixture of lead and quick lime is added to a melt of machine structural steel or Al-Si killed steel for use in automotive bodies, or even to a melt of low carbon, sulfur-containing free cutting steel (which is required to contain as much as 0.310–0.350% S). The low carbon, sulfur-containing steel in which desulfurization has occurred may often fail to comply with the specified sulfur content requirement and will result in poor quality.

The relationship between the addition of quick lime and the degree of desulfurization is shown in FIG. 1.

(ii) Quick lime is highly hygroscopic, so if it is added in a large amount, the water in the lime will cause an increase in the hydrogen level of the steel. Hydrogen is not desirable in machine structural steels, especially those for use in automotive bodies, and in order to prevent hydrogen pickup, special care must be exercised in handling quick lime or, alternatively, the apparent specific gravity of lead must be reduced by using a substance other than quick lime. The relationship between the addition of quick lime and hydrogen pickup is shown in FIG. 2.

(iii) When oxides of low-melting point metals such as lead oxide and bismuth oxide are added to liquid steel by either of the methods (a) to (c), the oxides are reduced by C, Al, Si or other reducing substances in the melt so as to form inclusions such as $Al_2O_3$ and $SiO_2$. As a result, the Al and Si contents in the steel undergo considerable variation and the overall composition of the liquid steel must be readjusted after the addition of such oxides of low-melting point metals.

(iv) In the methods of (b) and (c), the lead-containing substance is added to the liquid steel within a ladle merely by agitating the liquid steel in a short period of time and the sole control parameter is the rate of addition of lead (see Laid-Open Japanese Patent Publication No. 56562/1984). In the method (c) wherein a powder of lead or lead-containing substance is injected into the steel through a submerged lance, the yield or efficiency of lead addition is high and uniform diffusion of lead in the liquid steel is ensured to provide a steel of good quality. In accordance with the method of the present invention, a more uniform diffusion of lead in the liquid steel is ensured by controlling both the rate at which the lead is added to the liquid steel and the force of turbulence applied to the liquid steel by agitation.

SUMMARY OF THE INVENTION

The principal object, therefore, of the present invention is to eliminate the aforementioned problems of the prior art techniques and to provide a method of adding a source of low-melting point metal to molten steel, wherein the apparent (bulk) specific gravity of the source of low-melting point metal is reduced to a sufficiently small level to facilitate the transport of the source through a pipe and ensure the uniform dispersion of the source within the molten steel, so that the occurrence of desulfurization that is conventionally encountered in the use of quick lime in combination with the source can be minimized. This object can be sufficiently achieved by mixing two or more of the low-melting point metal, oxide thereof, quick lime and a carbonaceous material at specified proportions. The amount of quick lime that has to be used in the method of the present invention is sufficiently smaller than what is employed in the conventional method to avoid the problems of desulfurization and hydrogen pickup associated with the use of quick lime.

In accordance with the present invention, the liquid metal may be agitated by imparting the force of agitation thereto from the outside under specified conditions for the purpose of dispersing the additives within a minimal period of time, thereby increasing the yield or efficiency of addition of such additives.

DETAILED DESCRIPTION OF THE INVENTION

Figure 1:
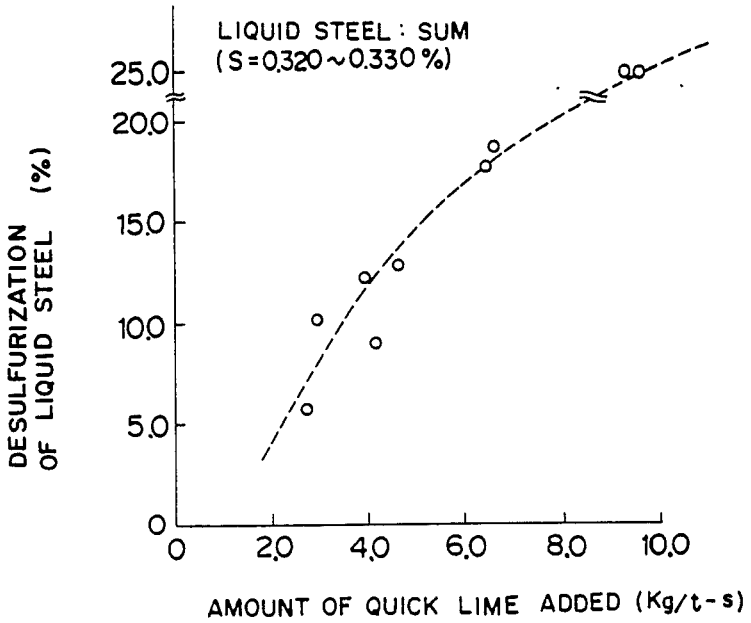
FIG. 1 is a diagram showing the relationship between the addition of quick lime and the degree of desulfurization of liquid steel.
Figure 2:
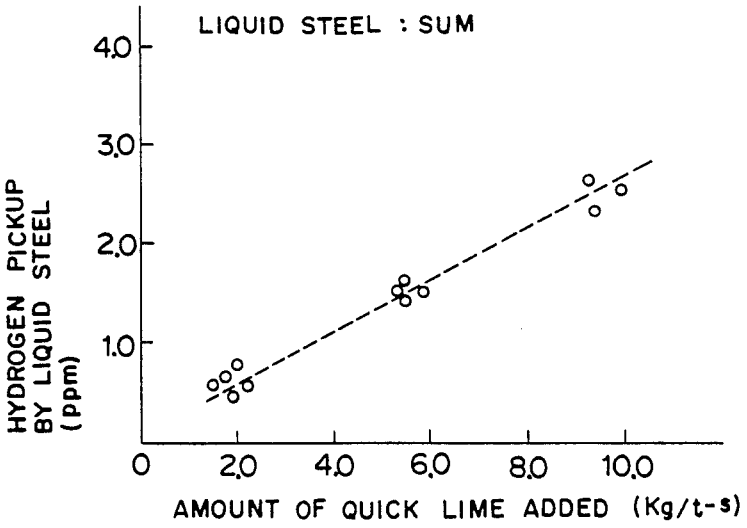
FIG. 2 is a diagram showing the relationship between the addition of quick lime and the amount of hydrogen pickup by the liquid steel.

In the method of the present invention, the source of low-melting point metal is supplied in the form of a mixture with quick lime for the following two reasons. Firstly, the apparent specific gravity of the source of low-melting point metal is reduced by mixing it with a quick lime powder having a small specific gravity. The source of low-melting point metal having a reduced apparent specific gravity can be carried at a lower flow rate and this in turn requires the use of a minimal flow rate of carrier gas with minimum loss in the supply pressure of the carrier gas. Secondly, the flowability of the source of low-melting point metal is increased to reduce its drag coefficient, thereby minimizing the required flow rate of carrier gas.

On the other hand, as mentioned earlier in this specification, the use of quick lime will cause quality-associated problems by introducing variations in the composition of molten steel on account of desulfurization and by increasing the hydrogen level in the steel.

In view of the aforementioned merits and demerits of the use of quick lime, the present inventors found that there is an optimal range for the mixing ratio of the source of low-melting point metal and the quick lime added. The inventors also found that the adding operation can be performed consistently under a broad range of conditions by taking special care in the handling of quick lime and by reducing the apparent specific gravity of lead by means of using a material other than quick lime either individually or in combination with quick lime. The present invention has been accomplished on the basis of these findings.

Therefore, in one aspect, the present invention provides the following two methods:

(1) A method of adding a low-melting point metal in liquid steel within a ladle, wherein one or more sources of low-melting point metal as mixed with either quick lime or a carbonaceous material or both in the amounts that satisfy the relations expressed by Formulas (1) to (3) are injected and added under the surface of the liquid steel through an submerged lance together with a gas:

$$x + y + z + m = 1 \quad (1)$$

$$5.5x + 3.3y + z + m \leqq 5.0 \quad (2)$$

$$\left.\begin{array}{l} 0 \leqq x < 1 \\ 0 \leqq y < 1 \\ 0 \leqq z \leqq 0.30 \\ 0 \leqq m < 0.25 \\ 0.1 \leqq z + m \leqq 0.30 \end{array}\right\} \quad (3)$$

(where x, y, z and m represent the weight proportions of the low-melting point metal, an oxide of said low-melting point metal, quick lime and the carbonaceous material, respectively).

(2) A method as defined above wherein the low-melting point metal is lead and is mixed with quick lime at a lead-to-lime ratio within the range of 3:1 to 5:1. Bismuth may be mixed similarly.

Formula (1) shows that the sum of the weight proportions of the low-melting point metal powder (x), oxide thereof (y), quick lime powder (z) and the carbonaceous material (m) is equal to unity. Formula (3) shows the range of the weight proportion of each of these components. Formula (2) is an empirical formula indicating that consistent adding-operations and uniform dispersion of the powder mixture in the liquid steel can be realized if the average bulk specific gravity of the powder mixture is no greater than 5.0. The weight proportions of x and y in the absence of m can be determined by substituting the relation $z=1-(x+y)$ into Formula (2).

In a preferred embodiment of the above-mentioned method (1) or (2), the added low-melting point metal can be dispersed uniformly in the liquid steel within a minimal period of time while providing a consistently high yield of the addition of the low-melting point metal by means of controlling both the rate at which the low-melting point metal is added to the steel and the force of agitation applied to the steel. In order to attain these objects, the present invention provides optimum conditions for addition of the low-melting point metal by means of imparting to the liquid steel the unit force of agitation, $\xi$ (force of agitation per unit speed of the addition of the low-melting point metal) represented by Formula (4):

$$\xi=(\dot{\xi}/R)\geqq 0.30\times 10^3[\text{Watt}\cdot\text{min/kg}] \quad (4)$$

where $\dot{\xi}$ is the force of agitation (watt/t-s) provided by a blown gas and is calculated by Formula (5):

$$\dot{\xi}=\left(0.0285\frac{Q\cdot T}{Wg}\right)\log\left(1+\frac{Z}{148}\right) \quad (5)$$

(where

Q: the amount of an inert gas (N1/min) blown as agitating medium;

T: the temperature of the liquid steel (K);

Wg: the amount of the liquid steel (ton); and

Z: the depth to which the gas is blown (cm)) and

R is the rate at which the low-melting point metal is added (kg/min.t-s) and is determined by Formula (6):

$$R=(M/t)\cdot(1/W_g) \quad (6)$$

where

M: the total amount of the low-melting point metal added (kg);

t: the time (min) for which the low-melting point metal is added; and $W_g$: same as defined in Formula (5).

In Formula (6), when oxide of the low-melting point metal is used, the amount of the low-melting point therein is calculated from the ratio of molecular weight. For example, when lead oxide or bismuth oxide is used, the amount of the low-melting point metal is equal to the amount of lead oxide or bismuth oxide x Pb/PbO or Bi/BiO, where molecular weight of Pb, O or Bi is 207.21, 16.00 or 209.00.

As represented by Formula (4), the unit force of agitation, $\xi$, is obtained by dividing the force of agitation applied to the liquid steel by the amount of the low-melting point metal added per unit amount of the steel. In other words, $\xi$ is the force of agitation applied to the low-melting point metal in consideration of the volume of the liquid steel.

The inert gas as the agitating medium may be blown into the liquid steel in a vessel through a basal porous plug or through an injection lance.

By meeting the requirements specified by Formulas (4) to (6), the low-melting point metal can be added to the liquid steel in a consistent manner without plugging the nozzle at the lance or causing splashing of the liquid steel by the blown gas, thereby ensuring a consistently high yield of the addition of the low-melting point metal.

Figure 3:
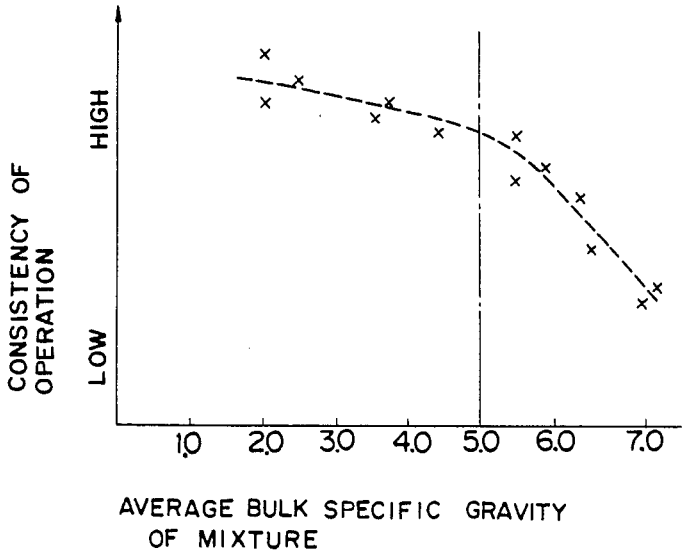
FIG. 3 is a graph showing the relationship of the average bulk specific gravity of a mixture of metallic lead, lead oxide and quick lime as plotted against the degree of consistency of adding operations.

FIG. 3 shows the relationship between the average bulk specific gravity of the mixture additive and the degree of consistency of adding operations in terms of smoothness of transport through a pipe and uniform dispersion of the additive. The data plotted in FIG. 3 were obtained by the experimental work of the present inventors. Obviously, the consistency of the adding operations is improved by reducing the average bulk specific gravity of the mixture additive, and is deteriorated if its average bulk specific gravity is increased. The consistency of the adding operations is seriously deteriorated if the average bulk specific gravity of the mixture additive exceeds 5.0 and, therefore, it is preferred to reduce the average bulk specific gravity of the mixture additive to 5.0 or below. It should be emphasized that transport of the mixture additive through a pipe may become impossible if the average bulk specific gravity of the additive exceeds 5.0.

The coefficients 5.5 and 3.3 for x and y in Formula (2) represent the average bulk specific gravities of the powder of low-melting metal (0.04–0.50 mm in size) and the powder of an oxide of said low-melting point metal (0.04–1.00 mm in size) on the basis of the average bulk specific gravity of a quick lime powder (finer than 250 mesh) which is assumed to be unity.

The present invention also proposes a method for reducing the apparent specific gravity of the low-melting point metal using substances other than quick lime. This method, based on the findings described above, consists of adding into the liquid steel a mixture of the low-melting point metal with a carbonaceous material, a mixture of an oxide of the low-melting point metal with a carbonaceous material, or a mixture of the low-melting point metal, an oxide thereof and a carbonaceous material. If desired, a carbonaceous material may be used in combination with quick lime.

Carbonaceous materials such as graphite and coke powder have small specific gravities close to unity, so by mixing them with a low-melting point metal having a high specific gravity, the apparent specific gravity of the latter can be reduced to a level that is low enough to ensure its uniform dispersion in the liquid metal into which said metal is injected. If the low-melting point metal is added to the liquid steel in the form of an oxide such as lead oxide or bismuth oxide together with the carbonaceious material, the latter dissolves in the liquid steel and reacts with the oxygen in the oxide while acting as a reducing agent for said oxide. The reaction product CO will escape from the steel in a gaseous form and will not be left therein as an inclusion.

Examples of the carbonaceous material that can be used in the present invention are graphite and the coke powder that results from the operations at ironworks. Both graphite and coke powder have bulk specific gravities within the range of 0.9–1.1, which are much smaller than the values for lead and bismuth (5.5–6.0). These carbonaceous materials are preferably used in amounts not smaller than 15%.

Unlike quick lime, neither graphite nor coke powder is hygroscopic and they will not raise the hydrogen level in the liquid steel even if they are added thereto.

The carbonaceous material, principally used as a reducing agent, may partly be utilized as a carbon source. The efficiency of utilization of the carbonaceous material as a carbon source will vary considerably with the type of steel in terms of the increase in the carbon content of the liquid steel. However, the addition of such carbonaceous materials will present no serious problem with respect to the steel composition if the yield of addition of the carbonaceous material is preliminarily determined for each of the steel types and if preliminary adjustment is made with respect to the primary components of carbon in the steel to be tapped from the converter.

The conditions for injecting the low-melting point metal into liquid steel through a submerged lance will vary according to the type of steel to be treated and will not be limited to any particular values, but for operations on an industrial scale, the following conditions are desirable:

| | | | |
|---|---|---|---|
| (1) | Flow rate of carrier gas | ≦ 80 $Nm^3$/hr | (for preventing splashing) |
| (2) | Rate at which the low-melting point metal is transported | ≧ 50 kg/min | (for the purpose of shortening the period of treatment and extending the life of lance) |
| (3) | Injection period | ≦ 20 min | |
| (4) | Solid to gas ratio | ≧ 30 | |
| (5) | Pressure at which the carrier gas is supplied from a blow tank | ≦ 10 $kg/cm^2$ | (high pressure should not be used |
| (6) | Particle size of the low-melting point metal: 0.04–0.5 mm<br>Average bulk specific gravity of the metal: 5.5<br>Range of variations in the bulk specific gravity: 5.0–6.0 | | |
| (7) | Particle size of an oxide of the low-melting point metal: 0.04–1.0 mm<br>Average bulk specific gravity of the metal: 3.3<br>Range of variations in the bulk specific gravity: 2.9–3.7 | | |
| (8) | Particle size of quick lime powder<br>Average bulk specific gravity: 1.0<br>Range of variations in the bulk specific gravity: 0.8–1.2 | ≦ 250 mesh | |
| (9) | Carbonaceous material: See Table 1 below. | | |

TABLE 1

(wt %)

| | C | S | P | N | Ash | $H_2O$ | Volatiles | Size (mm) | Bulk specific gravity |
|---|---|---|---|---|---|---|---|---|---|
| Coke Powder | 86.5~88.2 | 0.40~0.50 | 0.056~0.065 | 1.2 | 10.3~10.8 | <0.5 | 1.0~2.0 | 0.05~0.10 | 0.9~1.1 |
| Graphite powder | 79.0~82.0 | 0.04 | ≦0.035 | ≦0.07 | 16.0~18.0 | <0.5 | 2.0~3.0 | 0.05~0.1 | 0.9~1.1 |

If the source of low-melting point metal is lead, it may be blown into liquid steel in a consistent manner by limiting the ratio of lead to quick lime powder to lie within the range of 3:1 to 5:1 under such the conditions that are described in sections (1) to (9) before Table 1. This enables the production of a melt of lead-containing free-cutting steel in a more consistent manner without causing any quality-associated problems due to desulfurization or hydrogen pickup by the liquid steel.

Figure 4:
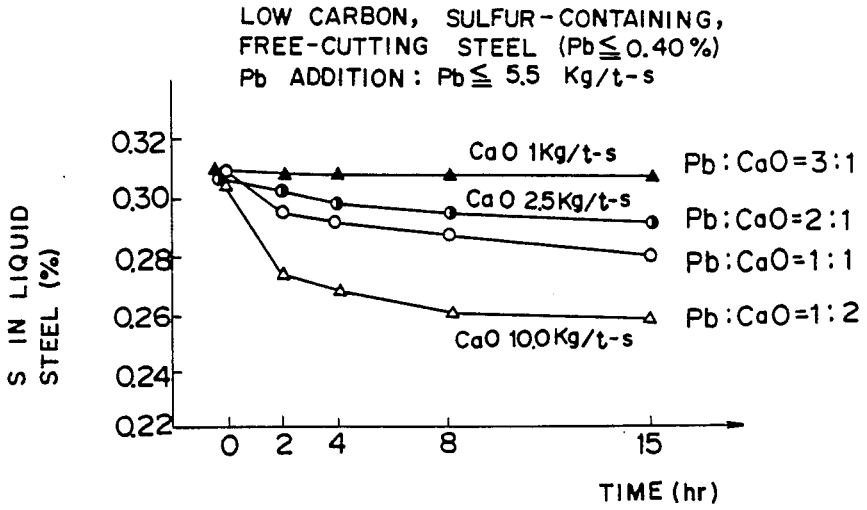
FIG. 4 is a diagram showing the time vs. sulfur content profile of a melt of low carbon, sulfur-containing free cutting steel, with the mixing ratio of lead and quick lime added being taken as a parameter.
Figure 5:
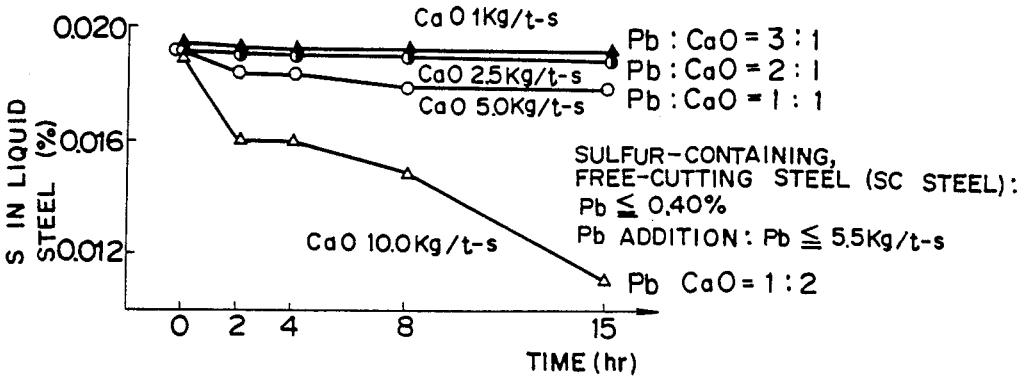
FIG. 5 is a diagram showing the time vs. sulfur content profile of a melt of machine structural, sulfur-containing free cutting steel (SC steel), with the mixing ratio of lead and quick lime added being taken as a parameter.

The ratio of the amount of lead to that of quick lime added is limited to the range of 3:1 to 5:1 for the following reasons. If the lead to quick lime ratio is less than 3:1, the excess quick lime will cause noticeable desulfurization not only in a melt of low carbon, sulfur-containing free-cutting steel (see FIG. 4) but also in a melt of SC steel (see FIG. 5). A low carbon, sulfur-containing free-cutting steel such as, for example, SUM 23 (JIS) is required to have [S] spec. of no less than 0.300%. Therefore, if the operator wants to produce SUM 23 by adding lead together with excess quick lime, he had to add sulfur source after completing the addition of lead or, alternatively, he must perform operations that precede lead addition under such conditions that a sulfur level higher than the upper limit of the specified range is attained. However, either practice will introduce great variations not only in terms of the procedures of operations but also with respect to the quality of the final product.

A mixture of lead and quick lime having a lead to lime ratio greater than 5.0 has a such a high apparent specific gravity that it cannot be transported through a pipe without causing its frequent plugging, thereby making it impossible to add the mixture through an injection lance in a consistent manner.

Figure 6:
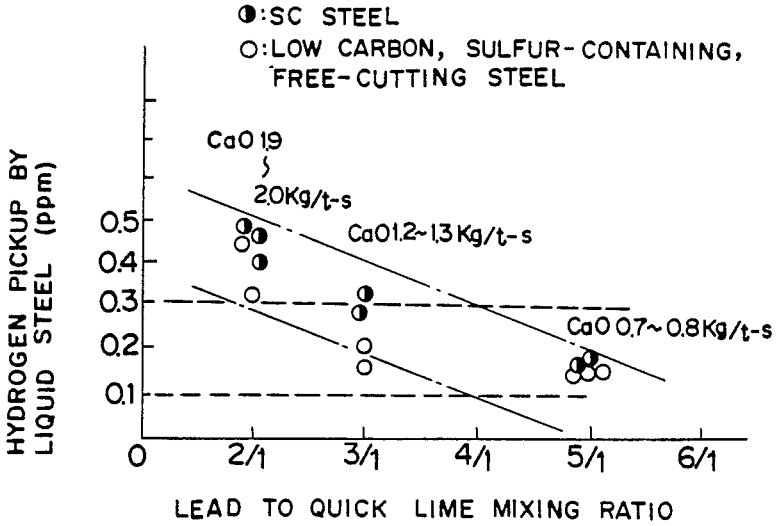
FIG. 6 shows the relationship between the mixing ratio of lead and quick lime added and the amount of hydrogen pickup by a melt of machine structural steel (SC steel) or low carbon, sulfur-containing free cutting steel.

The present inventors have also found that by limiting the lead to lime ratio to lie within the range of 3 to 5, it becomes possible to inhibit an increase in the hydrogen level of the liquid steel. As shown in FIG. 6, the hydrogen level in the liquid steel is obviously increased by increasing the proportion of quick lime in the mixture, but if the lead to lime ratio is within the range of 3 to 5, the hydrogen pickup by the liquid steel is held within the range of 0.1–0.3 ppm, which will by no means affect the quality of steel in an adverse manner.

Figure 7:
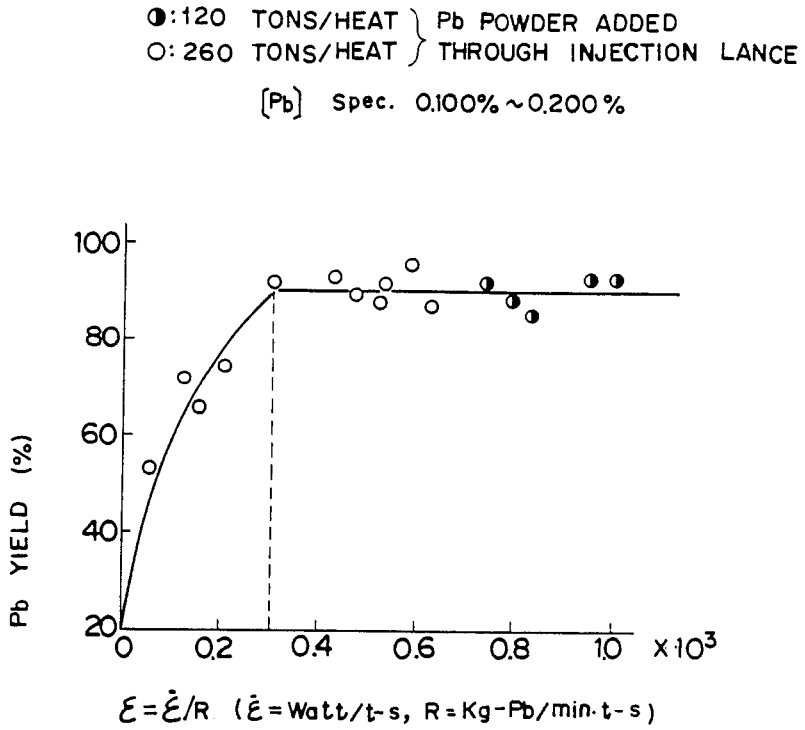
FIG. 7 is a diagram showing the relationship between the unit force of agitation applied to liquid steel and the yield of lead addition.

In the following pages, the effects of agitating the liquid steel on the yield of lead addition are described. FIG. 7 shows the relationship between the unit force of agitation, $\xi$, and the yield of lead addition. One can see from FIG. 7 that in order to attain a consistently high yield of lead addition, the unit force of agitation is required to satisfy the relation:

$$\xi \geqq 0.3 \times 10^3 [\text{Watt·min/kg}]$$

where lead is injected and added into the liquid steel through an injection lance.

The solubility of lead in molten steel generally lies within the range of 0.3–0.4% in the temperature range of 1,600°–1,650° C. Some researchers reported that the solubility of lead depends on the steel composition, especially on its sulfur content. In any event, the solubility of lead in liquid steel is small and would be a rate limiting factor for the yield of lead addition. It then follows that the loss of lead should be minimized in order to provide an improved yield of lead addition.

In order to minimize loss of lead from the calculated lead balance, its precipitation on the bottom of the ladle should be minimized and the duration of the residence time for which lead floats in the liquid steel should be maximized so that a sufficient time is ensured to achieve uniform dissolution and diffusion of the lead in the steel. In addition, in view of the solubility limit of metallic lead and its great tendency to precipitate (the specific gravity of lead is 11.34 which is about 1.5 times the value for iron), lead should be added to the steel in the smallest possible portions rather than it is added all at once. In terms of rate of addition, the smaller value will provide better results.

The present inventors made extensive studies on the relationship between the force of agitation applied to liquid steel and the rate of addition of lead. As a result, the inventors have found that in order to ensure a maximum yield of lead addition in a consistent manner in the case that lead is injected and added into liquid steel through an injection lance, the unit force of agitation, $\xi=\dot{\xi}/R$, which indicates the force of agitation that should be applied for the amount of lead to be added per unit amount of liquid steel must be limited to lie within a specified range. Stated more specifically, as one can readily see from FIG. 7, if $\xi=\dot{\xi}/R$ is equal to or greater than $0.3\times10^3$, yields of lead addition within the range of 85–95% can be attained consistently irrespective of the amount of liquid steel (ton/heat) or the shape or properties of the source of low-melting point metal.

EXAMPLE 1

A powder mixture of lead and quick lime was added to liquid steel under the following conditions.

| | | |
|---|---|---|
| (1) | Amount of liquid steel in a ladle | 110.5 tons |
| (2) | Amount and size of the lead powder added | 395.0 kg, ≦250 mesh |
| (3) | Amount and size of the quick lime powder added | 98.0 kg, 0.15–0.30 mm |
| (4) | Lead to quick lime ratio | 4:1 |
| (5) | Amount of inert gas blown | Ar at 60 $Nm^3$/hr |
| (6) | Inside diameter of nozzle at injection lance | 10 mm |
| (7) | Duration of blowing | 15 min. |

The steel compositions and temperatures before and after lead addition are shown in Table 2. The lead content in the treated liquid steel was 0.30 wt%, corresponding to 83.1% in terms of the yield of lead addition. The variations in the sulfur and hydrogen levels were 0.008 wt% and 0.1 ppm, respectively, and were not substantial enough to cause harmful effects on the quality of liquid steel. From the treated liquid steel, satisfactory blooms (247 mm×300 mm) weighing 10.9 tons could be produced using a curved type continuous casting machine.

TABLE 2

(wt %)

| | C | Si | Mn | P | S | Pb | H (ppm) | Temperature (°C.) |
|---|---|---|---|---|---|---|---|---|
| Before Pb addition | 0.09 | tr | 0.98 | 0.065 | 0.340 | tr | 1.8 | 1662 |
| After Pb addition | 0.08 | tr | 0.95 | 0.063 | 0.332 | 0.30 | 1.9 | 1615 |
| Required values | 0.07–0.09 | <0.02 | 0.85–1.05 | 0.060–0.080 | 0.300–0.350 | 0.25–0.35 | | |

EXAMPLE 2

A powder mixture of metallic lead, lead oxide and quick lime was added to a low carbon, high sulfur steel under the following conditions.

| | | |
|---|---|---|
| (1) | Amount of liquid steel in a ladle | 100.0 tons |
| (2) | Amount and size of the metallic lead powder added | 285 kg/ch, 0.05–0.2 mm |
| (3) | Amount and size of the lead oxide powder added | 160 kg/ch, 0.1–0.4 mm |
| (4) | Amount and size of the quick lime powder added | 55 kg/ch, <250 mesh |
| (5) | Average bulk specific gravity | 4.31 |
| (6) | Duration of blowing | 12 min |

The steel compositions and temperatures before and after lead addition are shown in Table 3. The lead content in the treated liquid steel was 0.325 wt%, corresponding to 75.5% in terms of the yield of lead addition. There was no change in the content of sulfur or hydrogen. From the treated liquid steel, satisfactory blooms (247 mm×300 mm) weighing 97.8 tons could be produced using a curved type continuous casting machine.

EXAMPLE 3

A powder mixture of metallic lead, lead oxide and quick lime was added to a machine structural, high carbon Al—Si killed steel under the following conditions.

| | | |
|---|---|---|
| (1) | Amount of liquid steel in a ladle | 102.5 tons |
| (2) | Amount and size of the metallic lead powder added | 175 kg/ch, 0.05–0.2 mm |
| (3) | Amount and size of the lead oxide powder added | 100 kg/ch, 0.1–0.4 mm |
| (4) | Amount and size of the quick lime powder added | 35 kg/ch, <250 mesh |
| (5) | Average bulk specific gravity | 4.30 |
| (6) | Amount of Ar gas blown | 60 $Nm^3$/hr |
| (7) | Duration of blowing | 8 min |

The steel compositions and temperatures before and after lead addition are shown in Table 4. The lead content in the treated liquid steel was 0.210 wt%, corresponding to 80.5% in terms of the yield of lead addition. There was no change in the concentration of sulfur or hydrogen. From the treated liquid steel, satisfactory blooms (247 mm×300 mm) weighing 100.5 tons could be produced using a curved type continuous casting machine.

TABLE 3

| | C | Si | Mn | P | S | Pb | H (ppm) | (wt %) Temperature (°C.) |
|---|---|---|---|---|---|---|---|---|
| Before lead addition | 0.09 | tr | 0.94 | 0.065 | 0.338 | tr | 1.8 | 1660 |
| After lead addition | 0.08 | tr | 0.87 | 0.065 | 0.338 | 0.324 | 1.8 | 1613 |
| Required values | 0.07–0.09 | <0.02 | 0.85–1.05 | 0.060–0.080 | 0.30–0.350 | 0.25–0.35 | — | — |

TABLE 4

| | C | Si | Mn | P | S | Pb | Al | H (ppm) | (wt %) Temperature (°C.) |
|---|---|---|---|---|---|---|---|---|---|
| Before lead addition | 0.55 | 0.25 | 0.81 | 0.019 | 0.018 | tr | 0.038 | 1.3 | 1610 |
| After lead addition | 0.54 | 0.18 | 0.78 | 0.020 | 0.018 | 0.210 | 0.032 | 1.3 | 1575 |
| Required values | 0.54–0.56 | 0.15–0.30 | 0.75–0.85 | ≦0.030 | 0.015–0.025 | 0.150–0.250 | 0.020–0.050 | <2.0 | — |

EXAMPLE 4

A powder mixture of metallic lead, lead oxide, quick lime and graphite was added to a machine structural, high carbon Al—Si killed steel under the following conditions.

| | | |
|---|---|---|
| (1) | Amount of liquid steel in a ladle | 102.5 tons |
| (2) | Amount and size of the metallic lead powder added | 175 kg/ch, 0.05–0.2 mm |
| (3) | Amount and size of the lead oxide powder added | 100 kg/ch, 0.1–0.4 mm |
| (4) | Amount and size of the quick lime powder added | 20 kg/ch, <250 mm |
| (5) | Amount and size of the graphite powder added | 20 kg/ch, 0.05–0.1 mm |
| (6) | Average bulk specific density | 4.20 |
| (7) | Amount of Ar gas blown | 60 $Nm^3$/hr |
| (8) | Duration of blowing | 9 min |

The steel compositions and temperatures before and after lead addition are shown in Table 5. The lead content in the treated liquid steel was 0.207 wt%, corresponding to 79.3% in terms of the yield of lead addition. The concentrations of sulfur and hydrogen were stable throughout the addition of lead, and experienced no change at all. From the treated liquid steel, satisfactory blooms (247 mm×300 mm) weighing 100.7 tons could be produced using a curved type continuous casting machine.

EXAMPLE 5

A powder mixture of metallic lead, lead oxide, quick lime and coke was added to a high carbon Al—Si killed (SC) steel for use in automotive bodies under the following conditions.

| | | |
|---|---|---|
| (1) | Amount of liquid metal in a ladle | 100.0 tons |
| (2) | Amount and size of the metallic lead powder added | 260 kg/ch, 0.05–0.2 mm |
| (3) | Amount and size of lead oxide power added | 160 kg/ch, 0.05–0.2 mm |
| (4) | Amount and size of the quick lime powder added | 30 kg/ch, <250 mesh |
| (5) | Amount and size of the coke powder added | 35 kg/ch, 0.05–0.1 mm |
| (6) | Average specific gravity | 4.20 |
| (7) | Gas blowing speed | 50 kg/min |
| (8) | Solid to gas ratio | 27 |
| (9) | Duration of addition | 10 min |

The steel compositions and temperatures before and after lead addition are shown in Table 6. The lead content in the treated liquid steel was 0.318 wt%, corresponding to 76.4% in terms of the total yield of lead addition. The carbon level was stable throughout the addition period and increased by merely 0.01 wt%. Because of the inclusion of quick lime and coke powders, the powder mixture had an average bulk specific gravity of 4.20 and could be transported through a pipe quite easily. Since CaO was used in a comparatively small amount, the concentrations of sulfur and hydrogen remained stable and experienced only very small changes. From the treated liquid steel, satisfactory blooms (247 mm×300 mm) weighing 98.2 tons could be produced using a curved type continuous casting machine.

TABLE 5

| | C | Si | Mn | P | S | Pb | Al | H (ppm) | (wt %) Temperature (°C.) |
|---|---|---|---|---|---|---|---|---|---|
| Before | 0.55 | 0.25 | 0.81 | 0.019 | 0.018 | tr | 0.042 | 1.3 | 1610 |

TABLE 5-continued

| | C | Si | Mn | P | S | Pb | Al | H (ppm) | (wt %) Temperature (°C.) |
|---|---|---|---|---|---|---|---|---|---|
| lead addition | | | | | | | | | |
| After lead addition | 0.54 | 0.23 | 0.80 | 0.020 | 0.018 | 0.207 | 0.032 | 1.3 | 1575 |
| Required values | 0.54–0.56 | 0.15–0.30 | 0.75–0.85 | ≦0.030 | 0.015–0.025 | 0.150–0.250 | 0.020–0.050 | <2.0 | — |

TABLE 6

| | C | Si | Mn | P | S | Pb | Al | H (ppm) | (wt %) Temperature (°C.) |
|---|---|---|---|---|---|---|---|---|---|
| Before lead addition | 0.54 | 0.25 | 0.81 | 0.017 | 0.018 | tr | 0.045 | 1.8 | 1613 |
| After lead addition | 0.55 | 0.24 | 0.80 | 0.019 | 0.019 | 0.318 | 0.034 | 1.8 | 1572 |
| Required Values | 0.54–0.56 | 0.15–0.30 | 0.75–0.85 | ≦0.030 | 0.015–0.025 | 0.300–0.350 | 0.020–0.050 | <2.0 | — |

EXAMPLE 6

A powder mixture of metallic lead, lead oxide, quick lime and coke was added to a low carbon, sulfur-containing free-cutting steel under the following conditions.

| | | |
|---|---|---|
| (1) | Amount of liquid metal in a ladle | 110.5 tons |
| (2) | Amount and size of the metallic lead powder added | 330 kg/ch, 0.05–0.2 mm |
| (3) | Amount and size of the lead oxide powder added | 75 kg/ch, 0.1–0.4 mm |
| (4) | Amount and size of the quick lime powder added | 40 kg/ch, <250 mesh |
| (5) | Amount and size of the coke powder added | 40 kg/ch, 0.05–0.1 mm |
| (6) | Average bulk specific gravity | 4.35 |
| (7) | Amount of Ar gas blown | 60 $Nm^3$/hr |
| (8) | Duration of blowing | 12 min |

The steel compositions and temperatures before and after lead addition are shown in Table 7. The lead content in the treated liquid steel was 0.304 wt%, corresponding to 83.3% in terms of the total yield of lead addition. The carbon level was stable throughout the addition period and increased by merely 0.01 wt%. Since CaO was used in a comparatively small amount, the changes in the S and H levels were negligibly small. From the treated liquid steel, satisfactory blooms (247 mm×300 mm) weighing 109.5 tons could be produced using a curved type continuous casting machine.

TABLE 7

| | C | Si | Mn | P | S | Pb | H (ppm) | (wt %) Temperature (°C.) |
|---|---|---|---|---|---|---|---|---|
| Before lead addition | 0.07 | tr | 0.98 | 0.065 | 0.332 | tr | 1.8 | 1662 |
| After lead addition | 0.08 | tr | 0.95 | 0.063 | 0.328 | 0.304 | 1.9 | 1615 |
| Required values | 0.07–0.09 | <0.02 | 0.85–1.05 | 0.060–0.080 | 0.300–0.350 | 0.25–0.35 | | |

EXAMPLE 7

A powder mixture of lead and coke was added to an Al-Si killed steel under the following conditions.

| | | |
|---|---|---|
| (1) | Amount of liquid metal in a ladle | 101.1 tons |
| (2) | Amount and size of lead powder added | 400 kg/ch, 0.05–0.2 mm |
| (3) | Amount and size of coke powder added | 80 kg/ch, 0.05–0.1 mm |
| (4) | Average bulk specific gravity | 4.70 |
| (5) | Blowing speed | 50 kg/min |
| (6) | Solid to gas ratio | 28.0 |
| (7) | Duration of addition | 10 min |

Because of the inclusion of coke powder, the powder mixture had a bulk specific gravity of 4.70 and could be transported and dispersed in the steel in a consistent manner. The steel compositions and temperatures before and after lead addition are shown in Table 8. The lead content in the treated liquid steel was 0.310 wt%, corresponding to 78% in terms of the yield of lead addition. The carbon level in the steel increased by 0.02%, indicating a coke reduction efficiency of about 30%.

The Si, Mn and Al levels decreased slightly but were still within the acceptable limits, causing no harmful effects on the steel quality. The hydrogen level did not increase, either. Therefore, the steel composition remained very stable throughout the addition period.

EXAMPLE 8

A powder mixture of lead oxide and coke was added to a low carbon, sulfur-containing free-cutting steel under the following conditions.

| | | |
|---|---|---|
| (1) | Amount of liquid steel in a ladle | 102.5 tons |
| (2) | Amount and size of the lead oxide powder added | 430 kg/ch, 0.05–0.2 mm |
| (3) | Amount and size of the coke powder added | 110 kg/ch, 0.05–0.1 mm |
| (4) | Average bulk specific gravity | 4.58 |
| (5) | Blowing speed | 55 kg/min |
| (6) | Solid to gas ratio | 31 |
| (7) | Duration of addition | 11 min |

The steel compositions and temperatures before and after lead addition are shown in Table 9. The yield of addition of lead oxide was 81.0% and the lead level in the treated liquid steel was 0.315 wt%. The carbon content increased by 0.03 wt% to a level of 0.08 wt%. Assuming that the remaining part of the coke was utilized in reducing the lead oxide, the reduction efficiency of coke is calculated to be 64.5%. The sulfur pickup from the coke was 0.002 wt%, which raised the sulfur content in the steel to 0.323 wt%. All the components in the treated liquid steel were within the required limits. These data support that lead oxide can be satisfactorily used as a lead source if it is mixed with a coke powder. From the treated liquid steel, satisfactory blooms (247 mm×300 mm) weighing 100.5 tons could be produced using a curved type continuous casting machine.

TABLE 8

| | C | Si | Mn | P | S | Pb | Al | H (ppm) | (wt %) Temperature (°C.) |
|---|---|---|---|---|---|---|---|---|---|
| Before lead addition | 0.54 | 0.23 | 0.82 | 0.015 | 0.017 | tr | 0.041 | 1.5 | 1620 |
| After lead addition | 0.56 | 0.20 | 0.80 | 0.016 | 0.017 | 0.310 | 0.037 | 1.5 | 1578 |
| Required values | 0.54–0.56 | 0.15–0.30 | 0.75–0.85 | ≦0.030 | 0.015–0.017 | 0.300–0.350 | 0.020–0.050 | <2.0 | — |

TABLE 9

| | C | Si | Mn | P | S | Pb | (wt %) Temperature (°C.) |
|---|---|---|---|---|---|---|---|
| Before lead addition | 0.05 | tr | 0.92 | 0.065 | 0.321 | tr | 1663 |
| After lead addition | 0.08 | tr | 0.86 | 0.067 | 0.323 | 0.315 | 1612 |
| Required values | 0.07–0.09 | <0.02 | 0.85–1.05 | 0.060–0.080 | 0.300–0.350 | 0.300–0.350 | — |

EXAMPLE 9

A powder mixture of bismuth oxide and coke was added to an Al-Si killed steel under the following conditions.

| | | |
|---|---|---|
| (1) | Amount of liquid steel in a ladle | 101.0 tons |
| (2) | Amount and size of the bismuth oxide powder added | 200 kg/ch, 0.05–0.2 mm |
| (3) | Amount and size of the coke powder added | 50 kg/ch, 0.05–0.1 mm |
| (4) | Average bulk specific gravity | 4.6 |
| (5) | Blowing speed | 50 kg/min |
| (6) | Solid to gas ratio | 28.0 |
| (7) | Duration of addition | 5 min |

Because of the inclusion of coke powder, the bismuth powder had a bulk specific gravity of 4.6 and could be transported in a consistent manner. The steel compositions and temperatures before and after bismuth addition are shown in Table 10.

The bismuth level in the treated liquid steel was 0.08 wt%, corresponding to about 45% in terms of the yield of bismuth addition. The carbon level increased by 0.02 wt%, indicating a coke reduction efficiency of about 40%. The Si, Mn and Al levels decreased slightly but were still within the acceptable limits, causing no harmful effects on the steel quality. The hydrogen level did not increase, either. Therefore, the steel composition remained very stable throughout the addition period. From the treated liquid steel, satisfactory blooms (247 mm×300 mm) weighing 99.8 tons could be produced using a curved type continuous casting machine. The above data show that bismuth oxide can be transported in a consistent manner if it is added simultaneously with coke. The data also show the possibility of using a large amount of bismuth oxide as a bismuth source.

EXAMPLE 10

A powder mixture of lead, lead oxide and coke was added to an Al-Si killed (SC) steel for use in automotive bodies under the following conditions.

| | | |
|---|---|---|
| (1) | Amount of liquid steel in a ladle | 100.0 tons |
| (2) | Amount and size of the lead powder added | 275 kg/ch, 0.05–0.2 mm |
| (3) | Amount and size of the | 160 kg/ch, 0.05–0.2 mm |

-continued

| | | |
|---|---|---|
| | lead oxide powder added | |
| (4) | Amount and size of the coke powder added | 100 kg/ch, 0.05–0.1 mm |
| (5) | Average bulk specific gravity | 3.90 |
| (6) | Blowing speed | 50 kg/min |
| (7) | Solid to gas ratio | 28 |
| (8) | Duration of addition | 11 min |

The steel compositions and temperatures before and after the lead addition are shown in Table 11. The lead content in the treated liquid steel was 0.343 wt%, corresponding to 81.1% in terms of the total yield of lead addition. The carbon level increased by 0.05 wt%, indicating a carbon reduction yield of about 60%. Because of inclusion of coke powder, the powder mixture has an average bulk specific gravity of 3.9 and could be easily transported through a pipe. Since no CaO was used, the S and H levels were stable and experienced very small changes as a result of lead addition. From the treated liquid steel, satisfactory blooms (247 mm×300 mm) weighing 98.1 tons could be produced using a curved type continuous casting machine.

To this liquid steel, a mixture of a lead powder (154 kg) and quick lime (40 kg) was added through an injection lance as an inert gas was blown at 60 $Nm^3$/hr to agitate the liquid steel. The lance had a nozzle of an inverted Y shape with two holdes (100 mmϕ) and was submerged to a depth of 1,080 mm. The injection was continued for 11.5 minutes during which the elemental lead powder was added at a rate of 13.4 kg/min. The sizes of the lead and quick lime powders were ≦350 mesh and 0.15–1.0 mm, respectively.

The treated liquid steel contained 0.075% C, less than 0.01% Si, 1.14% Mn, 0.067% P, 0.346% S and 0.139% Pb, and had a temperature of 1,600° C. Under the blowing conditions used, the unit force of agitation, ξ, was $0.95\times10^3$[Watt·min/kg], and the yield of lead addition was 92.0%.

From the treated liquid steel, blooms (247 mm×300 mm) having non-defective surfaces were produced using a curved type continuous casting machine. The blooms were rolled into billets which, as a result of ultrasonic inspection, were found to be free from beady lead inclusions, which are not uniformely dispersed, and any other defects resulting from inclusions. The product was satisfactory low carbon, lead-containing SC steel.

TABLE 10

| | C | Si | Mn | P | S | Bi | Al | H (ppm) | (wt %) Temperature (°C.) |
|---|---|---|---|---|---|---|---|---|---|
| Before bismuth addition | 0.54 | 0.23 | 0.82 | 0.015 | 0.017 | tr | 0.041 | 1.5 | 1620 |
| After bismuth addition | 0.56 | 0.20 | 0.80 | 0.016 | 0.017 | 0.08 | 0.037 | 1.5 | 1578 |
| Required values | 0.54–0.56 | 0.15–0.30 | 0.75–0.85 | ≦0.030 | 0.015–0.017 | 0.05–0.10 | 0.020–0.050 | <2.0 | — |

TABLE 11

| | C | Si | Mn | P | S | Pb | Al | H (ppm) | (wt %) Temperature (°C.) |
|---|---|---|---|---|---|---|---|---|---|
| Before lead addition | 0.50 | 0.25 | 0.81 | 0.017 | 0.018 | tr | 0.039 | 1.8 | 1613 |
| After lead addition | 0.55 | 0.23 | 0.78 | 0.020 | 0.019 | 0.343 | 0.034 | 1.8 | 1572 |
| Required values | 0.54–0.56 | 0.15–0.30 | 0.75–0.85 | ≦0.030 | 0.015–0.025 | 0.300–0.350 | 0.020–0.050 | <2.0 | — |

EXAMPLE 11

In this example, a lead powder (154 kg) was added to liquid steel (101.6 tons) through an injection lance. Liquid steel (0.46% Si, 0.49% Mn, 0.114% P, 0.020% S, 1,332° C.) was refined with oxygen in a converter. At the end of oxygen blowing, the steel contained 0.053% C, 0.28% Mn, 0.061% P and 0.026% S and had a temperature of 1,768° C. When this steel was tapped into a ladle, 700 kg of Mn as an alloyed iron, 518 kg of medium carbon Fe-Mn mixture also as an alloyed iron, 50 kg of iron phosphide and 690 kg of high purity sulfide minerals were added to the steel thus tapped, thereby making a low carbon, sulfur-containing free-cutting steel. The steel in the ladle contained 0.071% C, less than 0.01% Si, 1.14% Mn, 0.067% P and 0.346% S and had a temperature of 1,664° C.

As will be understood from the foregoing Examples, the method of the present invention enables the addition of a low-melting point metal to liquid steel in a consistent manner without plugging the piping system while ensuring uniform dispersion of the low-melting point metal within the steel and inhibiting the occurrence of desulfurization in the steel. Since the method eliminates or minimizes the occurrence of desulfurization during the addition of the low-melting point metal, the practice conventionally employed for avoiding any adverse effects of desulfurization caused by quick lime, i.e., adjusting the sulfur content of liquid steel either in a preliminary step or after the addition of the low-melting point metal, can be eliminated.

If a mixture of low-melting point metal and quick lime is added by the conventional practice to a melt of a machine structural steel that particularly hates the inclusion of hydrogen, the treated liquid has to be subjected to degassing under vacuum with a view to eliminating any hydrogen pickup. In the method of the present invention which employs a very small amount of quick lime, the increase in the hydrogen level of the steel as a result of addition of a low-melting point metal of interest is negligibly small and the treated steel has no particular need for subsequent dehydrogenation step.

A further advantage of the method of the present invention is that it permits efficient and uniform addition of a low-melting point of interest to liquid steel, thereby enabling the production of a high-quality steel containing said low-melting point metal.

What is claimed is:

1. In a method of adding a low-melting point metal to liquid steel within a ladle, the improvement wherein a low-melting point metal component consisting of at least one member selected from the group consisting of lead, bismuth, lead oxide and bismuth oxide is mixed with at least one member selected from the group consisting of quick lime and a carbonaceous material in the amounts that satisfy the relations expressed by the following formulas, and the mixture is blown into the liquid steel through an injection lance together with a gas:

$$x+y+z+m=1$$

$$5.5x+3.3y+z+m \leqq 5.0$$

$$0 \leqq x < 1$$

$$0 \leqq y < 1$$

$$0 \leqq z \leqq 0.30$$

$$0 \leqq m < 0.25$$

$$0 \leqq z+m \leqq 0.30$$

wherein x, y, z and m represent the weight proportions of the said low-melting point metal, an oxide of said low-melting point metal, quick lime and the carbonaceous material, respectively.

2. A method according to claim 1 wherein the low-melting point metal is lead and is mixed with quick lime at a lead-to-lime ratio within the range of 3:1 to 5:1.

3. A method according to claim 1 wherein the liquid steel into which the low-melting point metal and other necessary materials are blown through an injection lance together with a gas is agitated by said gas that imparts to the steel the unit force of agitation represented by the following formula:

$$\xi \geqq 0.30 \times 10^3 [\text{Watt·min/kg}]$$

where $\dot{\xi}=\xi/R$ where $\dot{\xi}$: the force of agitation (watt/t-s) provided by the blown gas, as represented by:

$$\dot{\xi} = \left(0.0285 \frac{Q \cdot T}{Wg}\right) \log\left(1 + \frac{Z}{148}\right)$$

R: the rate of addition of the low-melting point metal (kg/min·t-s), as expressed by:

$$R=(M/t)\cdot(1/Wg)$$

Q: the amount of the blown gas (N1/min)

T: the temperature of the liquid steel (K)

Wg: the amount of the liquid steel (ton)

Z: the depth at which the gas is blown (cm) into the liquid steel

M: the total amount of the low-melting point metal (kg) added t: the duration of addition (min).

4. A method according to claim 2 wherein the liquid steel into which the low-melting point metal and other necessary materials are blown through an injection lance together with a gas is agitated by said gas that imparts to the steel the unit force of agitation represented by the following formula:

$$\xi \geqq 0.30 \times 10^3 [\text{Watt·min/kg}]$$

where $\xi=\dot{\xi}/R$ where $\dot{\xi}$: the force of agitation (watt/t-s) provided by the blown gas, as represented by:

$$\dot{\xi} = \left(0.0285 \frac{Q \cdot T}{Wg}\right) \log\left(1 + \frac{Z}{148}\right)$$

R: the rate of addition of the low-melting point metal (kg/min·t:s), as expressed by:

$$R=(M/t)\cdot(1/Wg)$$

Q: the amount of the blown gas (N1/min)

T: the temperature of the liquid steel (K)

Wg: the amount of the liquid steel (ton)

Z: the depth at which the gas is blown (cm) into the liquid steel

M: the total amount of the low-melting point metal (kg) added t: the duration of addition (min).

* * * * *

UNITED STATES PATENT AND TRADEMARK OFFICE

CERTIFICATE OF CORRECTION

PATENT NO. : 4,686,081

DATED : August 11, 1987

INVENTOR(S) : KIYOSHI TAKASHIMA ET AL.

It is certified that error appears in the above-identified patent and that said Letters Patent is hereby corrected as shown below:

Column 20, line 1, change "$\dot{\xi} = \xi/R$" to read --$\xi = \dot{\xi}/R$--;

line 8, change "$\xi$" to read --$\dot{\xi}$--;

line 38, change "$\xi$" to read --$\dot{\xi}$--;

line 42, change "(kg/min·t:s)" to read --(kg/min·t-s)--.

Signed and Sealed this

Ninth Day of February, 1988

*Attest:*

*Attesting Officer*

DONALD J. QUIGG

*Commissioner of Patents and Trademarks*